United States Patent [19]

Norden

[11] Patent Number: 4,861,285

[45] Date of Patent: Aug. 29, 1989

[54] SWITCHING FUSIBLE APPARATUS

[75] Inventor: Alexander R. Norden, New York, N.Y.

[73] Assignee: Connectron, Inc., Laurence Harbor, N.J.

[21] Appl. No.: 155,815

[22] Filed: Feb. 16, 1988

[51] Int. Cl.[4] ..... H01R 33/95

[52] U.S. Cl. ..... 439/621; 337/213

[58] Field of Search ..... 337/195, 201, 208–210, 337/213, 226; 439/621, 622, 476, 483, 484, 852, 858, 862, 861

[56] References Cited

U.S. PATENT DOCUMENTS

| | | | |
|---|---|---|---|
| 2,917,612 | 12/1959 | Chabot | 439/861 |
| 4,076,369 | 2/1978 | Ostapovitch | 439/852 |
| 4,329,006 | 5/1982 | Gale | 337/213 |
| 4,411,486 | 10/1983 | Behrendt | 439/622 |
| 4,453,794 | 6/1984 | Wallner et al. | 439/621 |
| 4,481,496 | 11/1984 | Norden | 337/213 |
| 4,536,054 | 8/1985 | Wallner et al. | 439/621 |
| 4,568,137 | 2/1986 | Leuthold | 439/622 |

FOREIGN PATENT DOCUMENTS

| | | | |
|---|---|---|---|
| S 029705 | 12/1956 | Fed. Rep. of Germany | 439/852 |
| 1176004 | 1/1970 | United Kingdom | 439/622 |
| 1202346 | 8/1970 | United Kingdom | 439/622 |

*Primary Examiner*—Gary F. Paumen

[57] ABSTRACT

The disclosed switching fusible apparatus includes a fuse-holding device receivable in a receptacle and rotatable to "ON", "OFF" and "RELEASE" positions. The fuse-holding device comprises a fuse holder for containing a larger fuse and it may comprise the fuse holder containing an adapter which, in turn, contains a smaller fuse. A slot in the exposed end of the fuse holder receives a screw-driver for selectively turning the fuse-holding device when tool-operable apparatus is required, or a knob is interlocked with the slot in high-profile apparatus. Contact is made to each end cap of each fuse in the "ON" position of the fuse-holding device by a contact tab that is not significantly yielding per se but which is rendered prominently resilient by oppositely extending resilient torsion supports extending along the elongated fuse-holding device.

11 Claims, 4 Drawing Sheets

FIG. 4
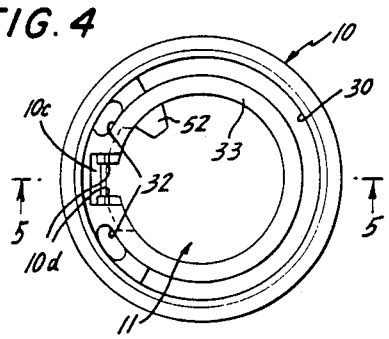
FIG. 11
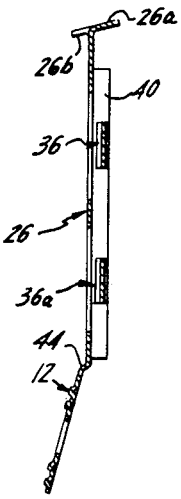
FIG. 10
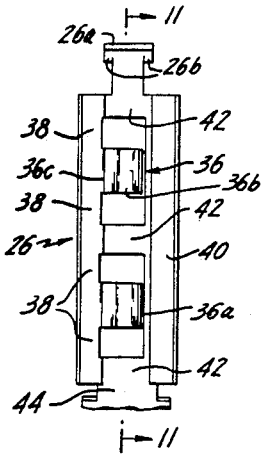
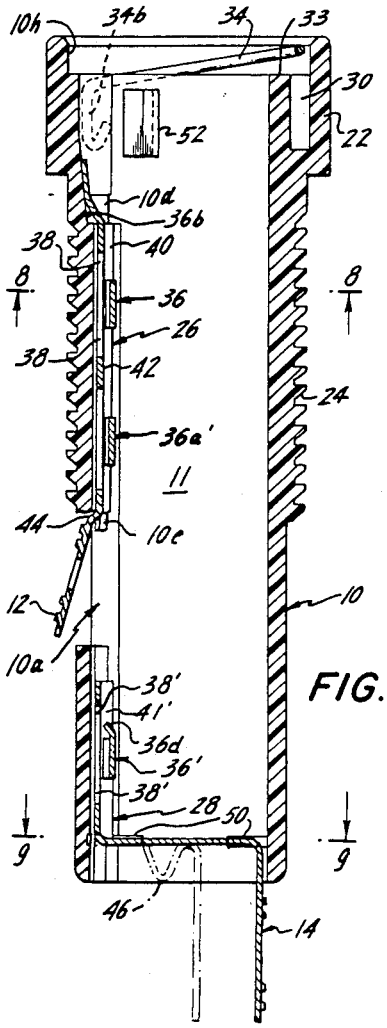
FIG. 5
FIG. 13
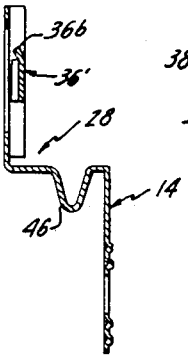
FIG. 12
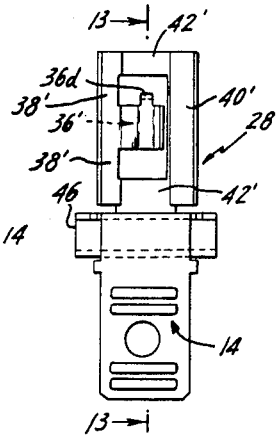
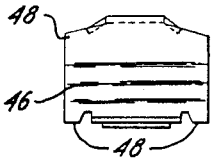
FIG. 12A FIG.14
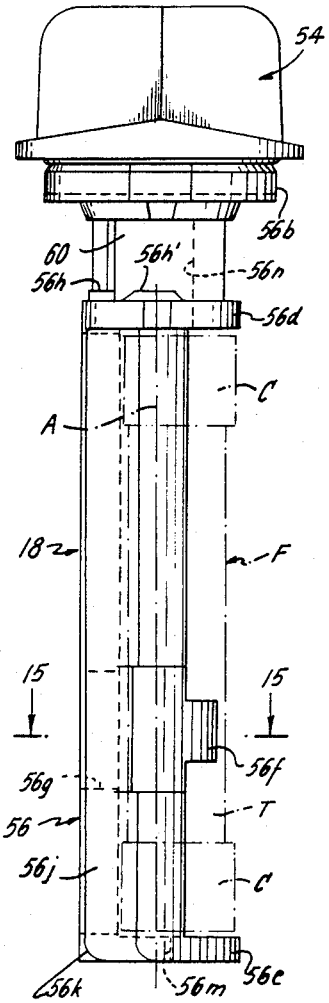
FIG.16
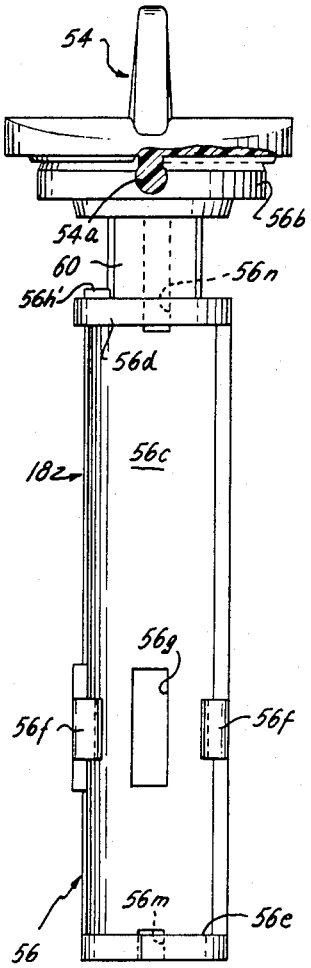
FIG.18
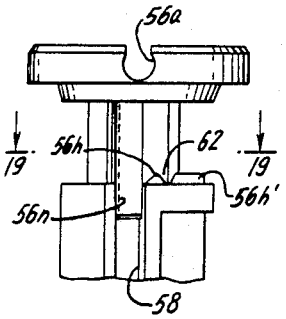
FIG.19
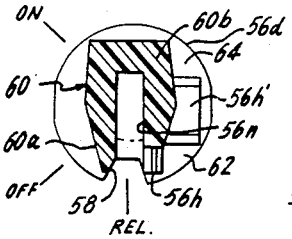
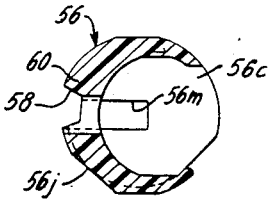
FIG.15
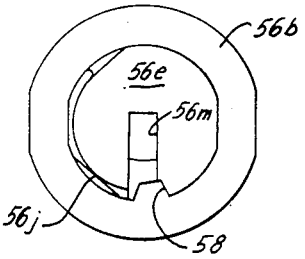
FIG.17

SWITCHING FUSIBLE APPARATUS

The present invention relates to electrical fuse receptacles, more particularly to switching fuse receptacles; and the invention relates to electrical contacts in such apparatus and to electrical contacts generally.

Electrical fuse receptacles are known in which a fuse holder is removable from a receptacle for replacing a fuse, in apparatus that also provides selective "ON" and "OFF" switching positions of the fuse holder. See for example my issued U.S. Pat. No. 4,481,496 issued Nov. 6, 1984. That patent discloses a fuse holder for so-called "glass" fuses. A "glass" fuse includes metal end caps on a tube of insulation—especially a glass tube—containing a fusible link connected between the end caps. The fuse holder is elongated and is rotatable about its longitudinal axis from a "REL" (Release) position to an "OFF" position and an "ON" position. The fuse holder is freely removable from the receptacle in the "REL" position; indeed, it is spring-biased so as to be raised partway out of the receptacle in the "REL" position. When a fuse has been inserted into the fuse holder, and when the fuse holder is in the receptacle, the end caps of the fuse are exposed outward of the receptacle's axis. The fuse holder can be turned a about its axis until the exposed end caps engage contact elements in the receptacle in the "ON" condition of the apparatus. In the "OFF" position of the apparatus, the end caps are spaced arcuately away from the receptacle contacts, both the fuse holder and its contained fuse being captive in the receptacle.

The present invention provides improvements in several respects over the switching fusible apparatus of my '496 patent. In one respect, the present novel fusible apparatus is capable of performing all of the functions of that apparatus when using either a "larger" or a "smaller" glass fuse. The "larger" fuse is longer than the other and it has larger-diameter end caps. The fuse-holding device is adaptable to contain each size of fuse and to carry the end caps into pressure contact with switching contact elements in the receptacle.

As a further improvement, the entire unit is of such small cross-section that it can be installed on a mounting panel simply by slipping the unit into a circular or a D-shaped panel opening. The unit is held in place by a nut that is threaded onto the receptacle. To be capable of being mounted in this way imposes an impressive difficulty: within the extremely small available space, switching contacts must be provided that are capable of carrying the heavy current for which some fuses are rated while providing the resilience and contact pressure required in performing the switching function.

Two contact members of the receptacle provide pairs of contact elements for short and long fuses. In the illustrative apparatus, one contact member has one contact element that serves in common for both sizes of fuses, while the other contact member has two spaced-apart contact elements, one for each size of fuse.

The contact elements must provide ample contact pressure for relatively high currents of some fuse receptacles (e.g. 16 Amps.) and they must provide substantial resilience—yet ample contact pressure—as is needed in practical switching operations. This is achieved within the extremely restrictive space that is available. The contact member includes a proportionally wide and short contact element having a movable contact portion and a supporting end portion that is carried by oppositely extending torsion supports. The axis of the torsion supports is transverse to the contact element and parallel to the axis of the switching fuse-holding device.

Such a short contact element with its oppositely extending torsion supports meets the exacting requirements of switching contacts in the described apparatus. However, it will be recognized that it is useful in other applications.

The elongated fuse-holding device turns about its longitudinal axis in the receptacle. It comprises a main member or "fuse holder" having a longitudinal groove for containing a "larger" fuse. The fuse holder carries the end caps of the "larger" fuse exposed outward for engaging contact elements of the receptacle when the fuse holder is turned to its "ON" position. For the "smaller" fuse, an adapter is part of the fuse-holding device. The adapter is proportioned like the larger fuse and it is receivable in the groove of the main elongated member, but the adapter and the main member have secure interlock or retention formations. The adapter has a channel for receiving the "smaller" fuse, positioned to engage contact elements of the receptacle.

The novel switching fusible apparatus is thus extremely compact, so that many units can be installed on a panel close to each other. One form of switching fusible unit can accommodate fuses of different dimensions. That apparatus includes resilient switching contact members configured uniquely to meet the limited available space while providing relatively high contact pressure and current-carrying capability. Such switching contact members are also useful in other applications.

As a further improvement, the novel switching fusible apparatus is usable either with a knob for manual operation or without a knob, requiring an operating tool instead. The knob projects from the mounting panel; it is used both for grasping the fuse-holding device when inserting or removing it, and for turning the fuse-holding device after insertion into the receptacle in order to switch it between "ON", "OFF" and "REL" positions. Where the apparatus is to be operated by a tool, the front end of the fuse-holding device has a tool-engageable formation, being a slot when a screwdriver is to be used.

The nature of the invention, including the foregoing and other aspects and advantages, will be best appreciated from the following detailed description of the presently preferred embodiment which is shown in the accompanying drawings.

IN THE DRAWINGS

FIG. 1 is a lateral view of exemplary switching fusible apparatus (considerably enlarged) embodying the various aspects of the invention;

FIGS. 2 and 3 are cross-sections of the apparatus of FIG. 1 at the planes 2—2 and 3—3 therein;

FIG. 4 is the top plan view of the insulating body of the fuse-holder receptacle in the apparatus of FIGS. 1–3;

FIG. 5 is a cross-section of the body of FIG. 4 at the plane 5—5 therein, plus switching contact members and an ejector spring contained in the apparatus of FIG. 1;

FIG. 10 is a fragmentary elevation of a contact member, being a component of FIGS. 5 and 8, this contact member being shown in a preparatory condition;

FIG. 11 is a vertical cross-section of the contact member of FIG. 10 at the plane 11—11;

FIG. 12 is a side elevation of another contact member, being a component of FIG. 5 and is shown in FIG. 12 in a preparatory condition;

FIG. 12A is a top plan view of the contact member of FIG. 12;

FIG. 13 is a vertical cross-section of the contact member of FIG. 12, at the plane 13—13 therein;

FIG. 14 is an elevation of a fuse holder that is contained in the apparatus of FIG. 1;.

FIG. 15 is a cross-section of the fuse holder of FIG. 14 at the plane 15—15 therein;

FIG. 16 is a side elevation of the fuse holder of FIG. 14 as seen from the right of FIG. 14;

FIG. 17 is a bottom plan view of the fuse holder of FIG. 16;

FIG. 18 is a fragmentary elevation of the fuse holder of FIG. 14 as seen from the left of FIG. 14;

FIG. 19 is a cross-section of the fuse holder of FIGS. 14–17 at the plane 19—19 of FIG. 18;

Figure 23:
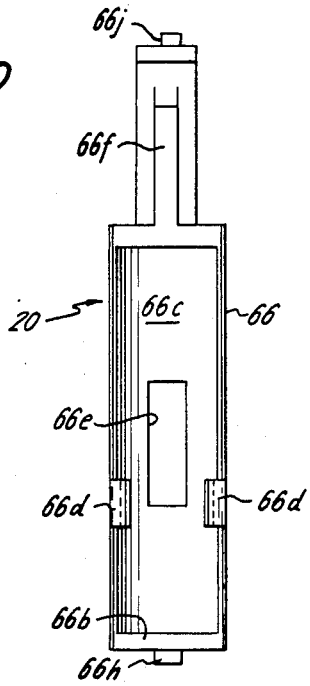
Figure 20:
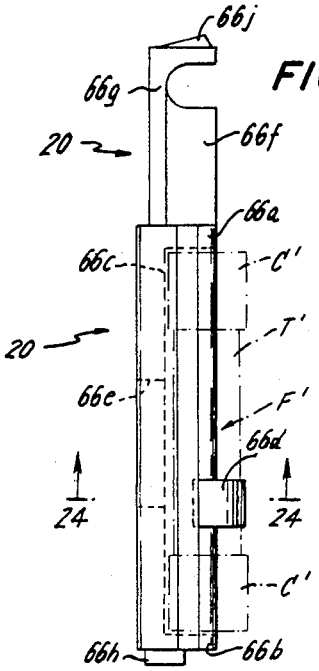
FIG. 20 is an elevation of an adapter forming part of a fuse holding device in the apparatus of FIGS. 1–3.
Figure 22:
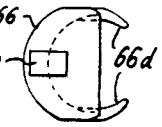

FIG. 23 s a right-side elevation of the adapter of FIG. 20; and

Figure 24:
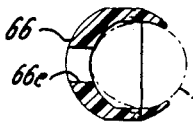

FIG. 24 is a cross-section of the adapter of FIGS. 20–23 at the plane 24—24 in FIG. 20.

Figure 1:
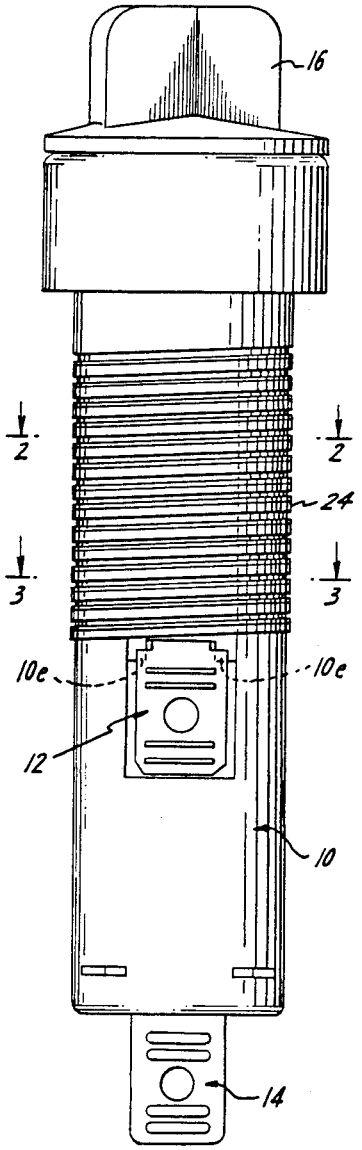
Figure 2:
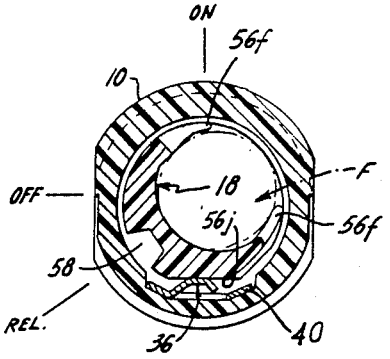
Figure 3:
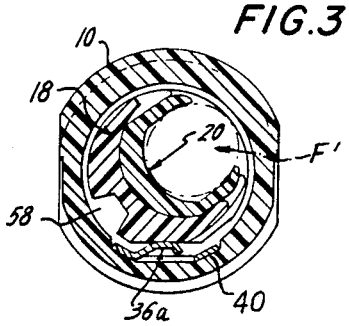

Referring now to the drawings, FIGS. 1–3 represent the assembled fusible switching apparatus. That apparatus includes a receptacle (FIG. 5) containing a fuse-holding device. That device may take the form of a fuse holder 18 alone (FIG. 2) or the fuse-holding device may be a two-part unit including fuse holder 18 containing adapter 20 (FIG. 3), depending on whether a larger or smaller fuse is to be used. In FIGS. 2 and 3, the fuse-holding device is shown in its "REL" position (see below) in condition for insertion into receptacle 10 or for removal.

Body 10 of the receptacle (FIGS. 1, 4 and 5) has external terminals 12 and 14. In the assembly (FIG. 1), knob 16 rotates the fuse-holding device to "ON" and "OFF" positions (FIG. 2) for the switching function and to the "REL" (Release) position for removing the fuse-holding device and for positioning the fuse-holding device when inserting it into the receptacle. The fuse-holding device can only be inserted into the receptacle in the "REL" position. A nut (not shown) cooperates with threads 24 on body 10 for securing the apparatus in a hole in a mounting panel (not shown). The legends "ON", "OFF" and "REL" are to be marked on the panel in the positions represented in FIG. 2. One of the two facets of body 10 (FIGS. 2 and 3) is to be matched to the straight edge of a D-shaped panel hole.

The fuse-holder receptacle as seen in FIG. 5 includes a body 10 of molded insulation. Enlargement or head 22 provides a mounting shoulder to bear against the mounting panel, or to bear against a bushing when the fusible apparatus is to project forward of the mounting panel.

Figure 6:
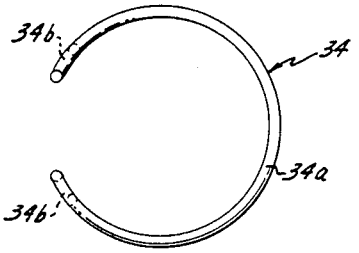
FIGS. 6 and 7 are a top plan view and a lateral elevation, respectively, of an ejector spring, being a component of the fuse-holder receptacle of FIGS. 1 and 5.
Figure 7:
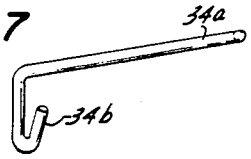

Body 10 has a generally cylindrical cavity 11 for receiving the fuse-holding device. First and second switching contact members 26 and 28 in body 10 cooperate with end caps of fuses in the fuse-holding device in its "ON" position. A groove 30 and two cavities 32 receive length 34*a* and retainer ends 34*b* of a spring 34 for ejecting the fuse-holding device when in its "REL" position. See FIGS. 4, 6 and 7.

Ejector spring 34 is shown in FIG. 5 in its unstressed condition. Anchoring formations 34*b* of the spring are locked in cavities 32 in insulating body 10. Portion 34*a* of the spring slants upward to the right in FIG. 5, above a slot 30. The fuse holder bears against shoulder 33 when inserted and turned away from its "REL" position. Spring 34 moves the fuse holder outward relative to the receptacle when the fuse holder is turned to the "REL" position. As will be seen below, the fuse holder must be pressed against (or close to) seat or shoulder 33 for turning the fuse-holding device successively to the "OFF" and "ON" positions and back to "REL".

Figure 8:
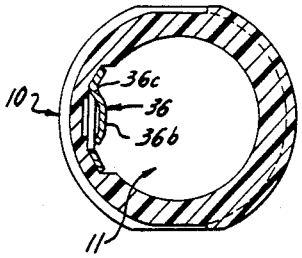
FIG. 8 is a cross-section of the receptacle of FIG. 5 at the plane 8—8 therein.

Switching contact member 26 (FIGS. 10 and 11) is made of resilient sheet metal having good contact-making properties, e.g. beryllium copper, and it provides ample resilience and contact pressure for the switching function. Member 26 includes two tabs 36 and 36*a* that are relatively wide and short, from the contact portion 36*b* to the supported end portion 36*c* (FIGS. 8 and 10). Contact portion 36*b* of tab 36 engages an end cap C of a fuse F when the fuse holder is in its "ON" position. Even though tab 36 is of resilient sheet metal, it is incapable of flexing significantly. Contact tabs 36 and 36*a* are proportioned alike. FIGS. 5 and 10–13 represent true proportions of illustrative contact members 26 and 28. These, in an example, are made of 0.012-inch thick beryllium copper having ⅛-inch square tabs 36, 36*a* and 36′for a 16-ampere fuse holder.

When the fuse-holding device of FIG. 2 or FIG. 3 rotates, it carries each fuse end cap C or C′ of the fuse (FIG. 14 or 20) along an arcuate path into contact with a tab 36, 36*a* or 36′. These tabs are cantilever elements that extend, from their supported ends to their free ends, along the paths of the fuse end caps as they move during switching, in planes perpendicular to the rotational axis.

Two resilient torsion segments 38, also called torsionally resilient support portions extend in opposite direction from the supported end 36*c* of each tab 36, 36*a*, transverse to the tab and along the length of the fuse holder.

When contact portion 36*b* of a tab is deflected forcibly by a fuse end cap C or C′, it behaves as a stiff lever that subjects resilient torsion segments 38 to twisting. Conversely, the torsion segments 38 maintain resilient pressure of each contact portion 36*b* against a fuse end cap. This is accomplished within a relatively small arc around the switching axis, and where there is only room for a short tab that cannot be flexed significantly when proportioned adequately for the required current-carrying capacity and contact pressure.

Contact member 26 includes a greatly elongated portion 40 and three transverse portions 42. Segments 38, portion 40 and portions 42 define frames around tabs 36 and 36*a*. The frame structure provides a means for anchoring the ends of torsion segments 38 remote from tabs 36, 36*a*, and the frames provide a means for mounting contact member 26 on insulating body 10 (as described below).

At its lower extremity, contact member 26 has an external terminal 12. A necked-in transition 44 has bends enabling terminal 12 to be securely positioned outside of body 10. As seen in FIGS. 1 and 5, terminal 12 has corners that overlie portions 10*e* of body 10.

Member 26 is shown in FIGS. 10 and 11 in its condition preparatory to being assembled to body 10. At its upper end, member 26 has a flag 26*a* that is almost at right angles to the rest of the member. That flag includes flanking hook portions 26*b*. Member 26 is assembled to body 10 by first inserting terminal 12 through opening 10*a* of body 10. This is facilitated by holding member 26 at a slant angle in cavity 11. Care is observed in arranging the transition portion 44 so that corners of terminal 12 overlie portions 10*e* of body 10 (FIG. 1).

Member 26 is then swung into place against the interior of body 10 as shown in FIG. 5. As this is done, flag 26*a* is erected (as shown) causing hook portions 26*b* to enter a cavity 10*c* and to become positioned behind obstructions 10*d* (FIGS. 4 and 5).

These described assembling operations result in each end of member 26 being fixed to body 10, securely positioning contact tabs 36 and 36*a*, without resort to separate fasteners and elaborate fastening operations.

Contact member 28 (FIGS. 12 and 13) is similar to member 26 in several ways. Member 28 includes contact tab 36', torsion supports 38' for tab 36', and frame portions 40' and 42', all as described above for like-numbered parts of member 26. Contact tab 36' has a cam 36*d* at its upper edge. If the upright portion of member 28 were to tilt slightly away from the wall of body 10, a fuse holder as it is being inserted would engage this cam 36*d* and deflect outward the upright portion of member 28. Accordingly, cam 36*d* assures smooth entry of the fuse holder past contact tab 36'.

As member 28 is made, in condition for assembly into body 10, it includes an upright portion that bears contact tab 36', a depending terminal 14 and an interconnecting base portion that includes a corrugation 46 and four projecting corners 48 (FIG. 12A).

Figure 9:
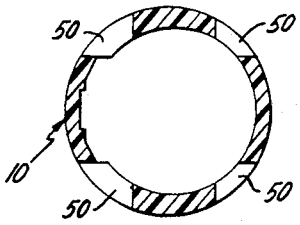
FIG. 9 is a cross-section of the body of FIG. 4 at the plane 9—9 in FIG. 5.
Figure 21:
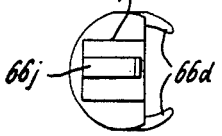
FIGS. 21 and 22 are top and bottom plan views, respectively, of the adapter of FIG. 20.

Member 28 is installed in body 10 by placing its upright contact portion in the position shown in FIG. 5, with two corners 48 in holes 50 (FIGS. 5 and 9); then corrugation 46 is flattened so that two other corners 48 enter two more holes 50 in body 10. In this way, member 28 is fixed in body 10 in a dependable, routine manner, without resort to separate fasteners.

Near its top opening, body 10 has an inward projecting key 52 that cooperates with a groove in the fuse-holding device (see below) to determine the angular relationship ("Release") between the fuse-holding device and the receptacle during insertion and removal.

As noted above, the fuse-holding device is a unitary device comprising only fuse holder 18 (FIGS. 14–19) for the larger (physically) of two different sizes of fuses. The fuse-holding device comprises the fuse holder and an adapter 20 (FIGS. 20–24) when a smaller fuse (physically) is used.

In FIGS. 14–19, fuse holder 18 comprises two elements, a knob 54 and a main member 56, each being a one-piece molded part of insulating plastic. Knob 54 is of a plastic that can be distorted under moderate stress, such as Lexan 940, a polycarbonate, having a bulging rib 54*a* that is forcibly inserted into a mating groove 56*a* in head portion 56*b* of member 56. The knob 54 and the head portion 56*b* have generally flat abutting surfaces at opposite sides of rib 54*a*. Knob 54 and main member 56 serve as a unitary device.

Knob 54 is used as a handle for the fuse-holding device when the latter is being inserted into the receptacle and for turning the fuse-holding device to any of its selective positions "ON", "OFF" and "REL". The knob also serves as a handle in removing the fuse-holding device.

In some applications, the fusible apparatus is to be operable only by a tool, for example a screwdriver. In such applications, knob 54 is not used so that head portion 56*b* of fuse holder 18 can be manipulated directly. It can be grasped for inserting and removing the fuse holder, inasmuch as spring 34 lifts the fuse holder (when set at REL) into a position projecting from receptacle body 10. When the knob 54 is not assembled to main member 56, groove 56*a* is available as a tool-receiving formation (as for a screwdriver) for turning the fuse holder to any of its selective positions. The tool-operable switching fuse holder in the drawings is nearly flush with the mounting panel in the "ON" and "OFF" settings.

Member 56 has a groove 56*c* along most of its length bounded by upper end wall 56*d* and lower end wall 56*e*, shaped and dimensioned for receiving a "larger" fuse F that is represented in dot-dash lines in FIG. 14. The fuse typically includes a tube T of insulation, glass being standard, enclosing a fusible link (not shown) and ferrules or metal end caps C that are interconnected by the link. Member 56 is shaped for guided rotation in cavity 11 of body 10 about axis A (FIG. 14). For this purpose, end walls 56*d* and 56*e* are generally round and slightly smaller in diameter than the generally cylindrical cavity 11 in body 10 of the receptacle. As is evident in FIG. 14, the fuse is eccentric relative to rotational axis A of member 56. The end caps C of the fuse are exposed (to the right in FIG. 14) for switching engagement with contact tabs 36 and 36' in the "ON" rotational position of fuse holder 18, i.e., member 56 with or without knob 54. End caps C bear against the bottom of groove 56*c* in member 56 when contact pressure of tabs 36 and 36' develops against the end caps in the "ON" position of the fuse holder. Tips 56*f* of member 56 are resilient detents that confine the fuse in groove 56*c*. When the fuse holder has been removed from the receptacle, a screw-driver or other suitable tool can be pushed against fuse F via slot 56*g* to remove the fuse.

A groove or keyway 58 extends along the back of member 56 opposite to the fuse-receiving groove 56*c*. Keyway 58 is open at the lower end of member 56 for admittinq key 52 (FIG. 5) and the keyway also extends through an upper wall 56*d* to merge with a space between upper wall 56*d* and head portion 56*b*. As the fuse holder 18 is being inserted into the receptacle, keyway 58 slides along key or projection 52. Ultimately, keyway 58 shifts below key 52 and the key is received in the space between head portion 56*b* and upper wall portion 56*d* of the fuse holder (FIG. 18). Manual pressure forces head portion 56*b* against seat 33 of receptacle body 10 (FIG. 5). Spring 34 is depressed into groove 30, so that fuse holder 18 is biased upward.

In this condition, portion 60*a* of neck 60 (FIG. 19) abuts key 52, so that the fuse holder cannot be turned counterclockwise (as viewed from above). Fuse holder 18 can be turned clockwise (as viewed from above) through a limited angle, about 135° in the example shown, from the "REL" position to the "OFF" position and to the "ON" position. Further turning of the fuse holder is blocked by engagement of key 52 with neck portion 60*b*.

The upper surface of upper wall 56*d* bears detents 56*h* and 56*h'* spaced angularly about axis A (FIGS. 14, 18 and 19). When the fuse holder has been turned so as to shift keyway 58 to the "OFF" position (FIG. 19), key 52 of the receptacle (FIGS. 4 and 5) is opposite to recess 62 between detents **56*h* and 56*h'*. Head portion 56*b* is received in recess 10*h* (FIG. 5) of body 10. Head portion 56*b* presses spring 34 into circular groove 30. When downward pressure against knob 54 or against head portion 56*b* is relaxed, spring 34 biases the fuse holder upward and key 52 is pressed into space 62 (FIG. 19) between detents 56*h* and 56*h'*. Turning fuse-holder member 56 about 90° farther clockwise, moves the fuse holder to the "ON" position, with detenting area 64 opposite to key 52. Portion 60*b* of neck 60 engages key 52 and blocks further clockwise motion of the fuse holder. Once again, relaxation of downward axial pressure on member 56 allows spring 34 to raise area 64 against key 52**. The fuse holder is then detented in the "ON" position.

Member 56 has a flat **56*j* (FIGS. 14 and 15) starting at its lower end and extending along most of its length. As the fuse holder is guided by key 52 and keyway 58 during insertion, flat 56*j* moves past contact tabs 36, 36*a* and 36' (FIGS. 2 and 3). The lower end of member 56, at flat 56*j*, is rounded or chamfered at 56*k* to provide added assurance of member 56 being inserted into the receptacle without danger of obstruction by tabs 36', 36 and 36*a***.

When fully inserted into the receptacle, the fuse holder containing fuse F (FIG. 14) can be turned clockwise from its insertion or "REL" position to its "ON" position (FIG. 2) so that one fuse cap C is brought into pressure contact with tab 36, the other fuse cap C then making pressure contact with tab 36'.

The fusible apparatus thus far described is also useful for the switching function described when using a smaller-diameter shorter-length fuse F' than fuse F of FIGS. 2 and 14. This is done by mounting adapter 20 of FIGS. 20–24 in fuse holder 18 of FIGS. 14–19. The fuse-holding device accomplishes the same functions and acts in the same way, both when the adapter is incorporated and when it is not. Contact tabs 36 and 36' serve when the fuse holder is used alone, while contact tabs **36*a* and 36'** serve when the fuse-holding device includes the adapter for the smaller fuse F'.

Adapter 20 (FIG. 3) comprises a one-piece molded member 66 having upper and lower end walls **66*a* and 66*b* (FIGS. 20–24) bounding the ends of a channel 66*c*** which is proportioned to receive a "smaller" fuse F', having a shorter glass tube T' than tube T and having smaller-diameter end caps C'.

Integral resilient turned-in tips **66*d* embrace tube T' for retaining fuse F' in the adapter. A slot 66*e* extends through member 66. Slot 66*e* is the same size as slot 56*g* of fuse holder 18**. These slots are in alignment with each other when the adapter is contained in the fuse holder, so that a screw-driver can be used to push fuse F' out of the adapter.

Adapter 20 includes a post **66*f*. Thinned neck 66*g* provides resilience for the top portion of post 66*f*. A projection 66*h* extends from bottom wall 66*b*, and a cam-like projection 66*j* extends from the top of post 66*f*. These projections are received in complementary slots in fuse holder 18** (see below).

In FIGS. 14–17, a slot **56*m* in the lower wall 56*e* merges with the space above wall 56*e* to create a through passage or hole. Similarly, a slot 56*n* is formed in upper wall 56*d* and the neck above that wall. That slot merges with the fuse-receiving space below upper wall 56*d*** to create a through passage or hole.

Adapter 20 is mounted in channel **56*c* of fuse holder 18 for accommodating smaller fuses F'. Projection 66*h* is placed in the hole formed by slot 56*m*; the adapter slants out of the fuse holder's groove 56*c*. Then the adapter is forced into the groove. Cam-like projection 66*j* is forced down a bit as it moves under top wall 56*d* of the fuse holder, neck 66*g* being resilient. When the adapter is near or at its fully inserted position, projection 66*j* snaps into the hole formed by slot 56*n*. In this way, adapter 20 is secured in position in fuse holder 18. Fuse F' is inserted into the adapter, retained by resilient tips 66*d*. The channel in the adapter locates end caps C' of the fuse in position to make pressure contact with tabs 36*a* and 36' when fuse-holding device 18, 20 is turned to the "ON" position. The adapter 20 is fixed in place of fuse F in fuse holder 18. Outward exposed portions of end caps C' are located at the same radius relative to axis A as the outward-exposed portions of end caps C of Fuse F (FIGS. 2 and 3). This common radius of the end caps C and C' is necessary here, where the same contact 36'** serves for both of the fuses.

So long as fuses F' continue to be used, adapter 20 remains interlocked with fuse holder 18. The adapter can be removed by first prying the upper detent formation **66*j*** of the adapter out of its hole in the fuse holder.

In both conditions of the apparatus—with and without the adapter—the three selective positions of the fuse-holding device are the same: "ON", "OFF" and "REL". The provision of a detented "OFF" position provides an assured "disconnect" selection. Keyway 58 is aligned with key 52 in the "release" adjustment, whereupon spring 34 raises the fuse-holding device for removal. This is particularly useful where the tool-operable form of the apparatus is used, omitting knob 54, because spring 34 raises the head portion **56*b* of member 56** so that it can be grasped easily.

It is evident that changes may be made in the illustrative switching fusible apparatus detailed above and shown in the drawings. Consequently, the invention should be construed broadly, in accordance with the spirit and scope of the invention.

What is claimed is:

1. Switching fusible apparatus for use with either a larger fuse or a smaller fuse each of which has an elongated insulating tube, metal end caps on the tube and a fusible link connected between said end caps, the smaller fuse being shorter than the larger fuse and having smaller-diameter end caps than those of the larger fuse, said apparatus including a receptacle having an elongated cavity open at one end and an elongated fuse holding device receivable lengthwise in said cavity and rotatable about an axis that extends along the cavity for shifting a fuse carried by the fuse holding device into and out of an "ON" position, said fuse holding device having means for selectively containing either said larger fuse or said smaller fuse with the end caps of the contained fuse exposed outward of said axis, contact portions of the end caps being movable in respective circular paths as the fuse holder is turned about said axis, said receptacle having contact means including at least three resilient contact elements at positions distributed along said cavity for engaging the end caps of that fuse, whether it is the larger fuse or the smaller fuse, which is carried by said fuse holding device, when in said "ON" position.

2. Switching fusible apparatus as in claim 1, wherein said contact means comprises two contact members having respective external terminals, two of said contact elements being part of one of said contact members and another of said contact elements being part of the other of said contact members.

3. Switching fusible apparatus as in claim 1, wherein said fuse-holding device includes a fuse holder and wherein said fuse containing means comprises a groove in the fuse holder that opens to one side of said axis for containing and locating one of said larger fuses so that its end caps are exposed and in position for engaging two of said contact elements, said fuse containing means including an adapter receivable in said groove at a prescribed position along said groove, said adapter when in said groove having a channel that opens to the same side of the fuse holder as said groove for receiving and locating one of said smaller fuses so that its end caps are exposed outward of said axis as aforesaid and in position for engaging two of said contact elements when the fuse-holding device is in its "ON" position.

4. Switching fusible apparatus as in claim 3, wherein said fuse holder and said adapter have aligned openings at the side opposite to that side at which said groove and said channel open, for insertion of a tool to push a small fuse out of the adapter.

5. Switching apparatus as in claim 1, wherein said contact means includes a sheet metal member in part comprising a said contact element, said contact element being formed as a tab having an end portion and a contact portion spaced apart along a said path of an end cap, said sheet-metal member also including resilient torsion segments extending from said end portion of the tab in opposite directions to respective remote ends, and means for providing restraining support for said remote ends.

6. Switching fusible apparatus as in claim 1, wherein said contact means includes a sheet-metal member in part comprising two of said contact elements, each contact element being formed as a tab having an end portion and a contact portion spaced apart along a respective one of said paths of the end caps, said sheet-metal member also including a pair of resilient torsion segments extending in opposite directions from the end portion of each of said tabs to respective remote ends, and means for providing restraining support for said remote ends.

7. Switching apparatus as in claim 1, wherein said contact means includes a sheet-metal in part comprising a said contact element, said contact element having an end portion and a contact portion spaced apart along a path of an end cap, said sheet-metal member defining a frame around said tab, said frame including resilient torsion segments extending from said end portion of the tab in opposite directions to respective remote ends and including means for providing restraining support for said remote ends.

8. Switching fusible apparatus as in claim 1, wherein said fuse-holding device has an end portion that is exposed for manipulation when the fuse-holding device is disposed in said cavity, said end portion being essentially flush with the end of the receptacle at which it is inserted, said end portion having a tool-engageable formation adapting the fuse-holding device to be turned about its axis, and a knob having a manual operating portion and having an opposite face engageable with said end portion of the fuse-holding device, said opposite face of the knob having a formation complementary to and interlocking with said tool-engageable formation.

9. Switching fusible apparatus for fuses of the type having an elongated insulating tube, metal end caps on the tube and a fusible link interconnecting said end caps, said apparatus including a receptacle and an elongated fuse-holding device, said receptacle having an elongated cavity with an opening at one end, and said elongated fuse-holding device being receivable lengthwise in said cavity via said opening and being rotatable about an axis along said cavity into and out of an "ON" position, said fuse-holding device being adapted to receive a fuse with portions of the end caps exposed outward of the axis, said receptacle having switching contact members including respective external terminals and having internal tabs spaced apart along the receptacle's cavity for engagement by the end caps of a fuse when the fuse-holding device is in its "ON" position, said fuse holding device having an end portion that is exposed for manipulation when the fuse-holding device is disposed in said cavity, said end portion being essentially flush with the end of the receptacle in which it is inserted, said end portion having a tool-engageable formation adapting the fuse-holding device to be turned about its axis, and a knob having a manual operating portion and having an opposite face engageable against said end portion of the fuse-holding device, said opposite face of tho knob having a formation complementary to and interlocking with said tool-engageable formation.

10. Switching fusible apparatus for fuses of the type having an elongated insulating tube, metal end caps on the tube and a fusible link interconnecting said end caps, said apparatus including a receptacle and an elongated fuse holding device, said receptacle having an elongated cavity with an opening at one end, and said elongated fuse holding device being receivable lengthwise in said cavity via said opening and being rotatable about an axis along said cavity into and out of an "ON" position, said fuse holding device being adapted to receive a fuse so that portions of the end caps are exposed outward of the axis and are movable along arcuate paths, said receptacle having contact members disposed for cooperation with the respective end caps of a fuse when the fuse holding device in its "ON" position, at least one of said contact members being a piece of resilient sheet-metal that includes a tab having a supported end portion and a contact portion spaced apart generally along a said arcuate path, said piece of sheet metal including torsionally resilient support portions extending integrally from said supported end portion of the tab and along said elongated cavity, said torsionally resilient support portions extending to respective mutually spaced-apart remote portions, said apparatus including means providing restraining support for said spaced-apart remote portions, arranged for disposing said contact portion of the tab in the arcuate path of a fuse end cap so that, as the fuse holding device carries the end caps of a fuse into said "NO" position, the contact portion is deflected and the torsionally resilient support portions become appreciably twisted resiliently.

11. Switching fusible apparatus as in claim 10, wherein said means providing restraining support for said spaced-apart remote portions includes further portions of said piece of sheet metal secured in place in said receptacle.

* * * * *